United States Patent [19]

Denz et al.

[11] Patent Number: 5,022,374

[45] Date of Patent: Jun. 11, 1991

[54] METHOD FOR SEQUENTIALLY INJECTING FUEL

[75] Inventors: Helmut Denz, Stuttgart; Klemens Grieser, Ditzingen; Jürgen Stock, Hochdorf/Enz; Rudolf Moz, Möglingen; Winifred Uttenweiler, Filderstadt, all of Fed. Rep. of Germany

[73] Assignee: Robert Bosch GmbH, Stuttgart

[21] Appl. No.: 551,410

[22] Filed: Jul. 12, 1990

[30] Foreign Application Priority Data

Jul. 15, 1989 [DE] Fed. Rep. of Germany ..... 3923478

[51] Int. Cl.[5] ..... F02D 41/06; F02D 41/34

[52] U.S. Cl. ..... 123/490; 123/491

[58] Field of Search ..... 123/490, 491, 179 L

[56] References Cited

U.S. PATENT DOCUMENTS

| | | | |
|---|---|---|---|
| 4,418,674 | 12/1983 | Hasegawa et al. | 123/179 L |
| 4,459,961 | 7/1984 | Nishimura et al. | 123/491 |
| 4,508,083 | 4/1985 | Hasegawa et al. | 123/179 L |
| 4,515,131 | 5/1985 | Suzuki et al. | 123/179 L |
| 4,732,122 | 3/1988 | Scarnera et al. | 123/179 L |
| 4,941,449 | 7/1990 | Höptner et al. | 123/490 |

FOREIGN PATENT DOCUMENTS

| | | | |
|---|---|---|---|
| 0058561 | 6/1987 | European Pat. Off. . | |
| 57-137626 | 8/1982 | Japan | 123/491 |
| 58-160523 | 9/1983 | Japan | 123/491 |
| 60-69247 | 4/1985 | Japan | 123/491 |

*Primary Examiner*—Andrew M. Dolinar

*Attorney, Agent, or Firm*—Walter Ottesen

[57] ABSTRACT

The invention is directed to a sequential fuel injection method wherein the first injection end time point is determined at which the preinjections end. In addition, the first intake end time point is determined at which a signal occurs for the first time after the start of the method which is evaluated as a signal that indicates the end of an induction operation. Furthermore, a determination is made for which cylinder the above-mentioned time point applies. If the first-mentioned time point lies ahead of the second-mentioned time point, the sequential fuel injection is started for the determined cylinder. For the opposite position of the mentioned time points, the injection valve for that particular cylinder is driven whose induction cycle follows the determined cylinder with the injection valve being so driven that the entire fuel quantity is injected which was computed for the sequential injection. The method of the invention assures that an internal combustion engine receives a proper injection as soon as possible after the start thereof without an overenrichment of the mixture for the individual cylinders.

3 Claims, 2 Drawing Sheets

METHOD FOR SEQUENTIALLY INJECTING FUEL

FIELD OF THE INVENTION

The invention relates to a method for sequentially injecting fuel wherein each one of a plurality of injection valves is driven at the start of injection to provide a preinjection.

BACKGROUND OF THE INVENTION

Sequential injection methods referred to below as SEFI-methods (Sequential Fuel Injection) are carried out in internal combustion engines wherein each cylinder is provided with an injection valve. The crankshaft position must be monitored in order that each injection valve is driven at the desired time point within a work cycle. The crankshaft position is monitored by scanning marks on a transducer wheel which rotates synchronously with the crankshaft. A work cycle extends over 720° or over two crankshaft rotations. As a consequence thereof, the crankshaft angle measured with the aid of the transducer wheel cannot clearly be assigned to the first or second part of the work cycle without an additional signal. The additional signal is supplied by a camshaft sensor which scans a mark on the crankshaft which rotates only once for two crankshaft rotations. Before an unequivocal synchronization is established, it is not possible to drive injection valves to the actual desired time point.

Metering fuel in accordance with an SEFI-method can therefore only be started in a delayed manner after the engine is started and this is most undesirable. For this reason, conventional methods provide that all injection valves are driven to each provide a preinjection at the start of the injection method. More specifically, the preinjections are only then supplied when adequate fuel pressure has built up. If the crankshaft position can be precisely determined shortly after the preinjection is supplied by the occurrence of the signal from the camshaft sensor and if then the regular fuel metering is permitted, then ignition will be missed in different cylinders because of an overenriching of the mixture. In order to overcome this disadvantage, the decision has been made that the regular fuel metering is delayed after supplying the preinjection for such a time that a double injection into a cylinder is avoided with certainty. Accordingly, European Patent 0,058,561 discloses a fuel injection control method wherein the preinjection is delayed after the start at least for a crankshaft angle of 720° before beginning with fuel metering pursuant to the SEFI-method. A disadvantage with this kind of method is that various cylinders receive no fuel in the time interval between the end of the preinjection and the beginning of the regular fuel metering.

SUMMARY OF THE INVENTION

It is an object of the invention to provide a sequential fuel injection method with preinjections wherein the regular fuel metering according to a SEFI-method can begin as rapidly as possible without overenrichment occurring.

The method according to the invention includes the steps of: determining the first injection end time point at which the preinjections end; determining the first intake end time point at which a signal occurs for the first time after the start of the method which is evaluated as a signal which indicates the end of an induction operation; and, determining the particular cylinder for which the first intake end time point applies; then when the first injection end time point lies ahead of the first intake end time point, the injection valve for the determined cylinder is driven so that it injects the full fuel quantity computed for the sequential injection; and, on the other hand, if the first injection end time point lies after the first intake end time point, then the injection valve for that particular cylinder having an induction cycle following that of the determined cylinder is so driven that the full fuel quantity is injected which was computed for the sequential injection.

In the method according to the invention, a comparison is made between the injection end of the preinjections and an intake end and the SEFI-method is not begun for the determined cylinder when the determined injection end only lies after the determined intake end. The foregoing assures that no overenrichment will occur but that the SEFI-method will nonetheless begin as rapidly as possible after the end of the preinjections.

Time points which are related to a SEFI-method were previously determined with the aid of so-called segment signals. Segment signals are as a rule set at angular positions which are optimized for the emission of ignition signals. In this way, they lie more or less close to the "intake closure".

This computed point is only equivocally fixed at constant rotational speed for a computation of the actual intake closure angle via time count starting at the segment mark and considerable errors occur with a dynamic rotational speed. For this reason, a segment signal is preferably evaluated as a signal which indicates the end of an induction operation when applying the method of the invention to a segment SEFI-method. If the preinjections end ahead of such a segment signal, then it is certain that the preinjections were ended also ahead of the end of the actual induction operation. Then the segment SEFI-method can be started without difficulty with the induction stroke for the next cylinder.

An increment SEFI-method is disclosed in German patent application P 39 23 479.7 for which a PCT application was filed on June 19, 1990 listing the United States of America as a designated state. In this method, the injection time point or more precisely the injection angle is determined with the aid of increment signals as they are supplied by a crankshaft increment transducer. By applying such a method, an increment value can be assigned with substantial accuracy to each induction end. Each of the increment values assigned in this manner is evaluated as a signal which indicates the end of the induction operation.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
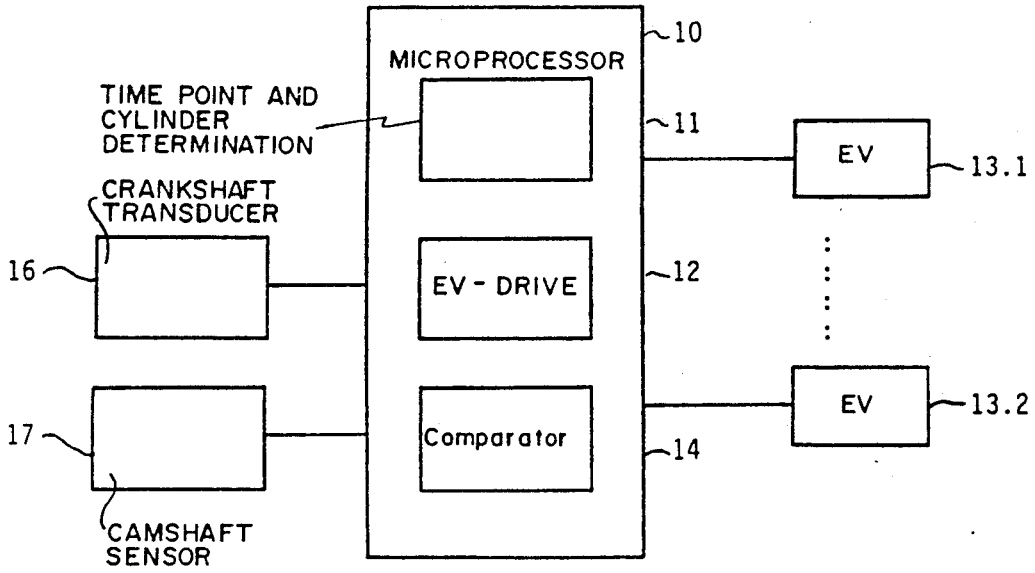
FIG. 1 is a block diagram of an arrangement for enabling sequential injection as soon as possible after the end of the preinjections.

The main component of the arrangement shown in FIG. 1 is a microprocessor 10 which realizes the following: a means 11 for determining the time points and cylinder numbers; a means 12 for driving injection valves (EV) 13.1 to 13.n; and, a comparison means 14. The microprocessor 10 receives signals from a crankshaft transducer 16 and a camshaft sensor 17. The crankshaft transducer can scan either a segment transducer wheel or an increment transducer wheel. Signals are emitted to the injection valves 13.1 to 13.n.

Figure 2:
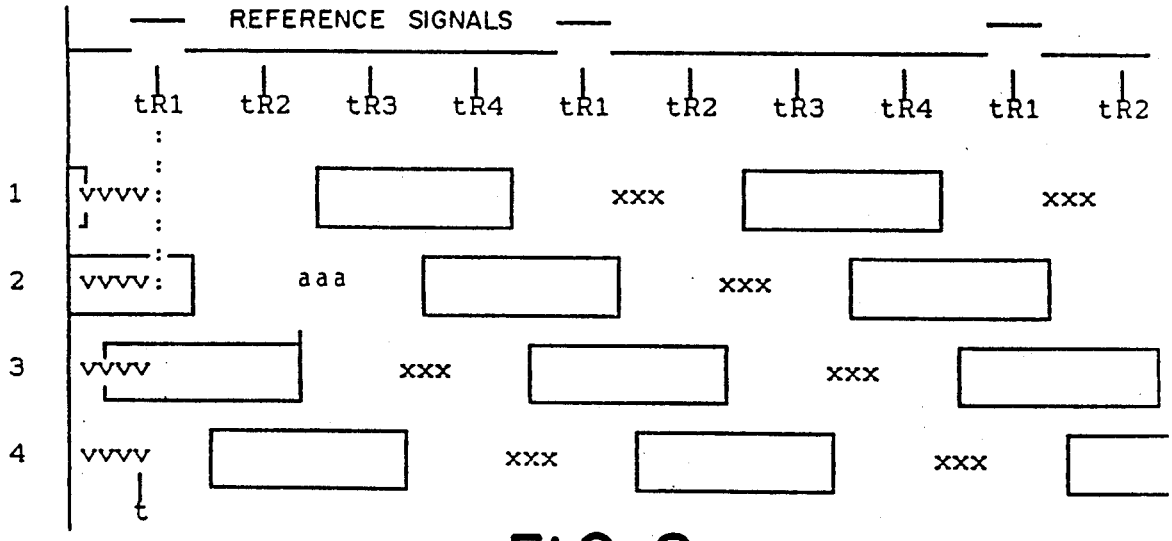
FIG. 2 is a first diagram for explaining a segment SEFI-method with preinjections.
Figure 3:
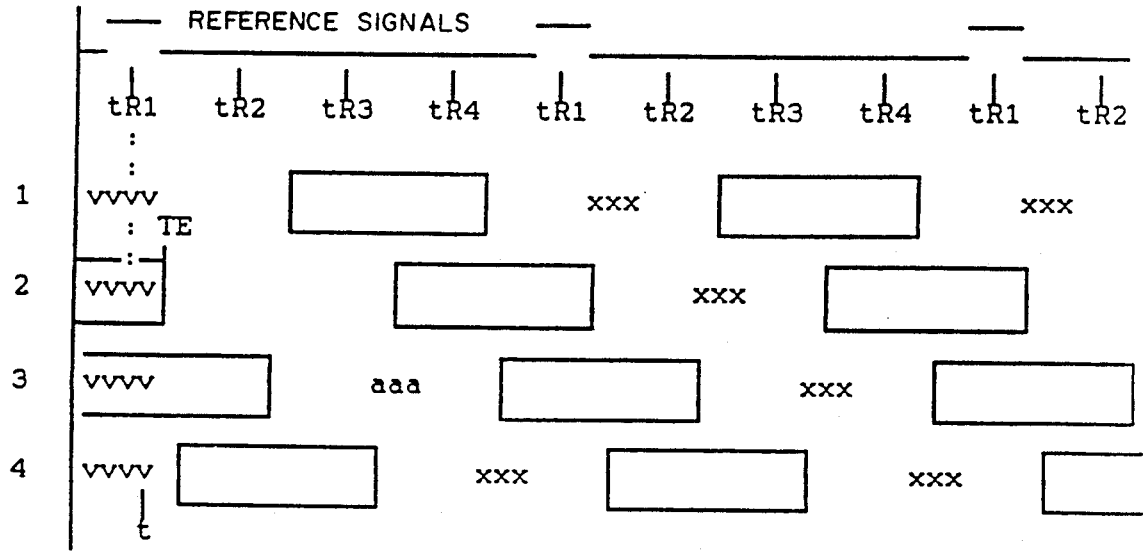
FIG. 3 is a further diagram for explaining segment SEFI-method with preinjections; and, FIG. 4 is a diagram for explaining an increment SEFI-method with preinjection.
Figure 4:
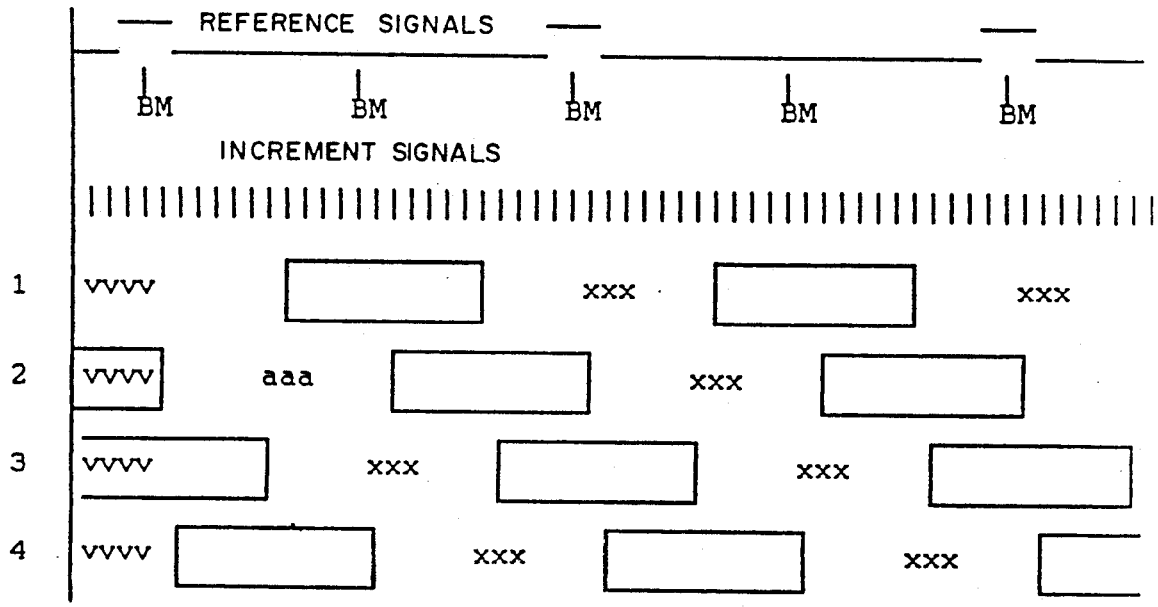

Methods which can be carried out with the aid of the arrangement of FIG. 1 are explained with respect to FIGS. 2 to 4. Sequences are illustrated as they apply to a 4-cylinder engine; however, the method is applicable to any desired number of cylinders.

FIGS. 2 to 4 all proceed from the premise that four cylinders are present having numbers 1 to 4 noted at the left margin of the diagram one below the other. This is a continuous numbering arranged in accordance with induction cycles and not ordered pursuant to the arrangement of the cylinders in a row within a cylinder block. For each cylinder, there is a sequence of intake crankshaft angle segments in which the intake valve arrangement associated to this cylinder is opened. These angular segments are marked by boxes. Fuel is injected into the cylinders or into the intake pipes arranged ahead of the particular assigned intake valve arrangement. Preinjections are identified by vvvv and the first proper sequential injection is identified by aaa and the further proper sequential injections are identified by xxx. The number of lower case letters is intended to indicate the duration of the particular injection. It is noted that for injections, time durations are determinative whereas the abscissas of the diagram are indicative of the crankshaft angle. If the rotational speed does not change, then fixed angle segments are assigned to fixed time intervals and vice versa. The following is based on this premise.

The segment SEFI-method according to FIGS. 2 and 3 as well as the increment SEFI-method according to FIG. 4 utilize a camshaft signal emitted by the camshaft sensor 17 every 720°. This camshaft signal is indicated in FIGS. 2 to 4 at the top thereof.

In addition to the camshaft signals, the segment SEFI-method according to FIGS. 2 and 3 utilizes segment signals tR1 to tR4 as they are emitted from the crankshaft sensor 15 every 180°. Two segment signals occur in the angular range over which one induction operation extends. The particular segment signal which is closer to the end of a particular induction operation than the other segment signal is of interest in the description which follows.

The diagram of FIG. 1 proceeds from relationships according to which an internal combustion engine is started shortly ahead of the occurrence of the camshaft signal and therefore ahead of the first segment signal tR1. However, the start should take place in time so far ahead of the mentioned signals that the preinjections are already ended at the occurrence of the first segment signal tR1. This time point is identified by (t) in FIG. 2. This time point (t) is the first injection end time point; that is, that time point at which the first injections, namely the preinjections, are ended. At the first injection end time point (t), a flag is set in the program carried out by the microprocessor 10. As soon as the first segment mark tR1 occurs, a check is made by the above-mentioned program as to whether the mentioned flag is set. The time relationships according to FIG. 2 show that this is the case. This shows that the preinjections were already ended before the first segment signal tR1 was emitted. In this way, it is also certain that the preinjections were ended ahead of the end of the particular induction cycle which ends next after the occurrence of the first segment signal tR1. This is cylinder 2 as shown by the time relationships according to FIG. 2. The time point at which the intake valve for cylinder 2 actually closes is indicated in FIG. 2 with tE. Since this time point cannot be precisely determined with a non-constant rotational speed, the time point of the occurrence of the first segment signal tR1 is evaluated as a first intake end time point; that is, it is assumed as an aid that the induction operation for cylinder 2 ends with the occurrence of the first segment signal. Cylinder 2 is that cylinder which ends its induction operation shortly ahead of the occurrence of the first segment signal tR1. Since the set flag indicates that the first injection end time point lies ahead of the first intake end time point, the sequential injection is begun with cylinder 2. This is illustrated in FIG. 2 by the letter series aaa ahead of the second induction operation for cylinder 2.

In the diagram of FIG. 3, the time relationships are so selected that the preinjections only end after the occurrence of the first segment signal tR1 but still ahead of the above-mentioned time point tE. Actually, the injection for cylinder 2 could be started as with the sequence according to FIG. 2 since cylinder 2 has inducted the entire preinjection fuel quantity already with its first induction stroke; however, the last-mentioned fact cannot be determined since, as explained above, the time point tE cannot be unequivocally determined. Instead, the time point of the occurrence of the first segment signal tR1 is again used as an aid for the first intake end time point. However, the above-mentioned flag had not yet been set at this time point. In this way, it is certain that the first injection end time point lies behind the first intake end time point. It is then assumed that the entire preinjection fuel quantity has not yet been inducted by the inducting cylinder, that is cylinder 2. Accordingly, the sequential injection is started with the cylinder (here cylinder 3) following the pertinent cylinder and this is shown in FIG. 3 by the letter series aaa ahead of the second induction cycle for cylinder 3.

For the angle relationships according to FIG. 3 just explained above, the sequential injection is started at 180° later than it actually could have been started. The maximum shift is 540° for the segment SEFI-method and the above-mentioned procedure. This occurs then when the method is started shortly after a camshaft mark which accordingly can no longer be detected. The synchronization then begins only approximately 720° after the start of the method when the camshaft mark is scanned for the first time and therefore a camshaft signal is supplied for the first time. The sequential injection is started for the second cylinder since at this time point, the preinjections have ended and the intake valve arrangement for the second cylinder is the next to close. However, no fuel is available in the induction strokes for the cylinders 3, 4 and 1.

The maximum displacement is reduced to 360° when a synchronization is undertaken every 360° instead of only every 720° by means of the special combination of the camshaft signals and the segment signals.

As explained, the problem is present for the segment SEFI-method that the actual intake end time point tE for cylinder 2 (and correspondingly for all other cylinders) cannot be precisely determined. Because of the engine construction, the crankshaft angle for the intake end is precisely fixed; however, only the segment signals tR1 to tRn are emitted synchronously with the crankshaft angle so that the angle for the intake end cannot be precisely monitored; instead, this angle can only be determined with the aid of a count of time pulses. The number of time pulses to be counted is however dependent upon the rotational speed at the time. If this speed changes in an unexpected manner after the determination of the pulses counted, then the intake end is incorrectly determined. For this reason, the segment signals per se are utilized in a segment SEFI-method with preinjections in order to determine a first intake end time point.

In contrast to the above, a precise determination can be made as to when an inlet end crankshaft angle is reached if an increment SEFI-method is applied. In such a method, an increment signal is emitted by the crankshaft increment transducer 16 every 6° of the crankshaft angle. These increment signals are shown in FIG. 4 but not with the fine divisions of 6°. Reference mark signals BM are used in addition to the increment signals and the camshaft signals already mentioned. The reference mark signals BM can be derived from an increment transducer gear wheel gap of the crankshaft transducer every 360° of the crankshaft angle. If a reference mark signal and a camshaft signal occur simultaneously, then this is an indication that cylinder 2 is just ahead of the end of its induction operation. If in contrast, the reference mark signal occurs without a simultaneously available phase signal, then this is an indication that cylinder 4 is just ahead of the end of its induction. Increments can be counted already from the start of the method and it can be determined at which increment the preinjections ended and at which increment after the start of the method that the first intake end occurred. The first increment number is evaluated as the first injection end time point and the second increment number as the first intake end time point. For which cylinder the determined first intake end time point applies is dependent upon how many increments this time point lies ahead of the first determined reference mark. In this way, the first injection end time point, the first intake end time point and the particular cylinder for which the last-mentioned time point applies can all be unequivocally determined with an increment SEFI-method.

To provide a better overview, FIG. 4 proceeds from somewhat simpler time relationships than those which correspond to the general description provided above. Thus, FIG. 4 is based on time relationships according to which the first injection end time point and the first intake end time point lie after the occurrence of the first reference mark signal BM. It is assumed that the first scanned reference mark is that which shows that the induction operation for cylinder 2 will shortly end. The increment signals which occur thereafter are counted up starting with the value 1. The end of the preinjections or the first injection end time point lies just after an increment and is therefore determined with the following increment and the end of the induction operation for cylinder 2 that is the first intake end time point lies just after a later increment and is determined for the increment following this one. Since the first intake end time point lies after the first injection end time point, it is assured as with the time relationships according to FIG. 2 that the entire preinjection fuel quantity is inducted by cylinder 2. Therefore, the sequential injection is begun directly for this determined cylinder. If on the other hand, the preinjections would end only after the first intake end time point, then the sequential injection would be started with cylinder 3 (not shown).

With a segment SEFI-method, a determination can be made whether the first injection end time point lies ahead of the first intake end time point or not only with a yes/no decision. However, with an increment SEFI-method, the angular difference between these two time points can also be computed. It can be further computed as to what percent of the preinjection fuel quantity was not inducted in the induction cycle when the preinjection extended beyond the first intake end time point. However, this computation can be erroneous for non-constant rotational speed since the above-mentioned difference between the time points is an angular difference but the preinjection continues for a certain time interval which covers different angular regions at different rotational speeds. It should be noted that in the start operation with which we are here exclusively concerned, a relatively significant change in rotational speed takes place. The preinjection time interval can be converted into an angular segment if the change is monitored and evaluated. By means of a comparison of this angle segment with the angle segment lying between the above-mentioned two time points, that preinjection fuel quantity can be relatively precisely determined which is injected after the first intake end time point for the pertinent cylinder. The sequential injection can be started for the pertinent cylinder already since this quantity is known. However, the residual quantity not inducted from the corresponding preinjection is to be subtracted from the fuel quantity for the first injection.

The embodiments described and illustrated show that it is possible to determine the above-mentioned first intake end time point in different ways. Preferably, this time point is precisely determined which however is only possible with an increment system. The first segment signal is used in a segment system instead of the actual first end of an induction operation after synchronization of the method. In lieu thereof, a time point can be used which lies after the occurrence of the segment signal by a predetermined time interval. This time interval must be dimensioned so short that it does not lie after the end of the above-mentioned induction operation when there is a significant increase in rotational speed.

The embodiments further show that the first injection end time point can be determined and evaluated in different ways. The simplest way is to merely set a flag when the first injection end time point lies ahead of the intake end time point. The precise time after the start of the method can be determined also by counting time pulses. If an increment system is utilized, it is preferably determined at which increment the preinjections have ended.

If an increment system is used, increments for the mentioned time points can already be determined before the angle count is synchronized to the camshaft signal and the reference mark signals. A subsequent computation can be made for which cylinder the first induction operation has ended after the start of the method by counting the increments starting with this increment value up to the occurrence of the first camshaft signal.

It is understood that the foregoing description is that of the preferred embodiments of the invention and that various changes and modifications may be made thereto without departing from the spirit and scope of the invention as defined in the appended claims.

What is claimed is:

1. A sequential fuel-injection method wherein each of a plurality of injection valves is driven to supply respective preinjections when the method is started, the method comprising the steps of:

determining a first injection end time point at which the preinjections end;

determining a first intake end time point at which, after the method has been started, a signal appears for the first time which can be evaluated as a signal that indicates the end of the induction operation;

determining the particular cylinder for which the first intake end time point applies; and, when the first injection end time point lies ahead of the first intake end time point, driving the injection valve for said particular cylinder so as to cause the fuel quantity to be injected that was computed for the sequential injection; or, when the first injection end time point lies after the first intake end time point, driving the injection valve for that cylinder whose induction cycle follows the induction cycle of the particular cylinder so as to cause the fuel quantity to be injected that was computed for the sequential injection.

2. The method of claim 1, wherein that signal that is evaluated as a signal is a segment signal which indicates the end of an induction operation; said segment signal being emitted by a crankshaft angle sensor every 720°/n, and lying closest to the end of an induction operation.

3. The method of claim 1, wherein increment signals are counted as they are supplied by a crankshaft increment transducer, the signal which is evaluated is that signal which indicates the end of an induction operation and is supplied when a pregiven increment value is emitted.

* * * * *